US011193274B2

(12) United States Patent
Mellon

(10) Patent No.: US 11,193,274 B2
(45) Date of Patent: Dec. 7, 2021

(54) PROTECTIVE DIVIDER

(71) Applicant: Mark Mellon, Moseley, VA (US)

(72) Inventor: Mark Mellon, Moseley, VA (US)

( * ) Notice: Subject to any disclaimer, the term of this patent is extended or adjusted under 35 U.S.C. 154(b) by 543 days.

(21) Appl. No.: 16/140,928

(22) Filed: Sep. 25, 2018

(65) Prior Publication Data

US 2019/0093346 A1 Mar. 28, 2019

Related U.S. Application Data

(60) Provisional application No. 62/562,649, filed on Sep. 25, 2017.

(51) Int. Cl.

| | |
|---|---|
| ***E01F 15/10*** | (2006.01) |
| ***E06B 9/00*** | (2006.01) |
| ***E04B 2/74*** | (2006.01) |
| ***E01F 13/02*** | (2006.01) |
| ***E04H 6/42*** | (2006.01) |

(52) U.S. Cl.

CPC ..... *E04B 2/7437* (2013.01); *E01F 13/022* (2013.01); *E04H 6/42* (2013.01)

(58) Field of Classification Search

CPC ..... E06B 9/52; E04B 2/7437; E01F 15/10; E01F 13/022; E01F 15/08; E01F 15/086; E01F 15/088; E04H 6/42

USPC ..... 160/351

See application file for complete search history.

(56) References Cited

U.S. PATENT DOCUMENTS 3,677,322 A * 7/1972 Brorson ..... E06B 9/0669 160/135
4,085,789 A * 4/1978 Steiner ..... A47G 5/00 160/135
4,134,439 A * 1/1979 Scott ..... A47G 5/00 160/135
4,312,600 A * 1/1982 Schaaf ..... B63B 51/02 116/107
4,645,183 A * 2/1987 Rattray ..... A47D 13/063 256/25
4,681,302 A * 7/1987 Thompson ..... E01F 8/0035 256/13.1
4,854,767 A * 8/1989 Sasaki ..... E01F 13/022 404/6
5,054,507 A * 10/1991 Sparks ..... E04H 15/003 135/97
5,070,665 A * 12/1991 Marrin ..... A47F 5/105 52/239
5,208,585 A * 5/1993 Sprague ..... E01F 15/086 116/63 T
5,269,623 A * 12/1993 Hanson ..... E01F 7/00 256/13.1

(Continued)

*Primary Examiner* — Daniel P Cahn
(74) *Attorney, Agent, or Firm* — Gutwein Law; Greg Geiser

(57) ABSTRACT

A protective barrier device adapted for placement within a structure with a particular use adjacent to a vehicle. The device includes a pair of base members comprised of a hollow housing having a cavity for the addition of a weighted material. The device including a top rail and a bottom rail assembled from sections and coupled to the base members to define a perimeter of the device. A central portion generally comprising a panel is shaped for receipt within the perimeter and coupled to the rails in a cohesive assembly. The device is configured for assembly from a collapsed to an extended position for easily transport and shipping.

6 Claims, 7 Drawing Sheets

(56) References Cited

U.S. PATENT DOCUMENTS 5,402,988 A * 4/1995 Eisele ..... E01F 13/022 160/351
5,460,353 A * 10/1995 Rittenhouse ..... A63B 71/028 160/135
5,498,101 A * 3/1996 Braverman ..... E01F 15/086 256/13.1
5,779,227 A * 7/1998 Elkins ..... E04H 17/18 256/24
5,967,214 A * 10/1999 Beretta ..... E01F 13/022 16/366
D415,901 S * 11/1999 Arko ..... D6/332
5,993,103 A * 11/1999 Christensen ..... E01F 9/70 116/63 P
6,008,938 A * 12/1999 Suehle ..... E01F 9/654 359/443
6,086,285 A * 7/2000 Christensen ..... E01F 13/022 256/1
D458,040 S * 6/2002 Stannis ..... D6/332
7,351,008 B2 * 4/2008 Yodock, III ..... B63G 9/00 405/71
7,849,653 B2 * 12/2010 Guertin ..... E04H 3/14 52/582.1
8,579,262 B2 * 11/2013 Sadinsky ..... E04H 17/163 256/26
9,038,299 B1 * 5/2015 Uribe ..... E01F 13/02 40/610
2002/0121063 A1 * 9/2002 Mathias ..... E04H 17/16 52/578
2006/0245826 A1 * 11/2006 Shaw ..... E01F 15/086 404/6
2010/0301295 A1 * 12/2010 West ..... E01F 13/022 256/24
2012/0207541 A1 * 8/2012 Maus ..... E01F 13/00 404/6
2012/0247056 A1 * 10/2012 Sawyers ..... E06B 9/52 52/656.9
2014/0353565 A1 * 12/2014 Ditta ..... E01F 13/022 256/59
2016/0215462 A1 * 7/2016 Marchetti ..... E01F 7/00
2016/0222611 A1 * 8/2016 Welch ..... E01F 13/022
2017/0101751 A1 * 4/2017 Ditta ..... E01F 13/022
2018/0223561 A1 * 8/2018 Howell ..... E01F 15/088
2018/0327986 A1 * 11/2018 Cook ..... E01F 15/088

* cited by examiner

PROTECTIVE DIVIDER

CROSS REFERENCE TO RELATED APPLICATIONS

This application claims priority to U.S. Provisional Patent Application No. 62/562,649 filed 25 Sep. 2017 to the above named inventor, and is herein incorporated by reference in its entirety.

FEDERALLY SPONSORED RESEARCH OR DEVELOPMENT

Not Applicable

SEQUENCE LISTING, A TABLE, OR A COMPUTER PROGRAM

Not Applicable

FIELD OF THE INVENTION

The present disclosure relates generally to a protective divider configured for generally segregating an area and, more particularly, for placement adjacent to automobiles.

BACKGROUND

Often when parking a vehicle within a structure, such as a garage, the vehicle is exposed to, and often, subjected to contact from surrounding objects, additional vehicles, or people. This exposure and subsequent contact can result in damage in the form of scratches, dents, nicks, and other types of damage to the vehicle.

One method and device for the protection of a vehicle from damage is the construction of a barrier, wall, or wall-like structure. Within the current marketplace there exist permanent, semi-permanent, and temporary structures. Generally these structures are a fixed dimensioned surface extending a fixed length, width, and height and configured as solid or hollow structures. Although these structures are beneficial and useful, they can be bulky, heavy, and difficult to maneuver. Therefore, there exists a need within the market for improved barrier system that is configured for portability. Preferably, this barrier system is adapted for customization, provides adequate protection, and is configured to allow for attachment of additional barriers.

SUMMARY OF THE INVENTION

The present disclosure provides a protective barrier device configured to form a protective barrier adjacent to a vehicle. The protective barrier is configured to withstand high impacts and includes a structural assembly with a low center of gravity to prevent tipping and provide stability. The barrier device of the present disclosure is provided in an assembly that is movable from a collapsed to an extended position, wherein the barrier device is easily converted to assembly for storage or shipping. Accordingly, the barrier device functions as a protective divider to keep an automobile damage free and more generically section or cordon off a designated area.

The present disclosure protective barrier includes a pair of co-operating base members, a pair of rail members, and a center portion. The base members generally configured to provide stability to the device and adapted as mirrored images of each other and configured for placement on the opposed ends of the barrier device. The pair of base members constructed of a housing forming a generally hollow cavity. The cavity enclosed and accessible through a cover member, wherein a user can remove the cover for access to the cavity enabling the filling of the cavity with a material, such as, but not limited to, sand or water to increase the weight of the base members. The base members further including a movable foot member. The movable foot member configured to secure an adjacent base member in a coupling.

The pair of rail members comprising a top rail and a bottom rail. The rail members further comprised of a pair of sections in an assembly to make a complete top rail and bottom rail. The rail members extending between the base members and coupled to and connecting the base members. In the preferred embodiment, the top rail is generally arcuate in shape wherein a central portion of the arc of the top rail is the intersection of the pair of sections and positioned at a height above the height of the pair of base members.

The central portion is configured for coupling in the space between the assembly of the pair of rail members and the pair of base members to form a generally continuous structure of the device. The central portion shaped to correspond to the assembly space and coupled to the members. An upper edge of the central portion including a pair of cut-outs adjacent to the top rail to generally form a gap between the central portion and top rail, wherein the cut-outs generally allow a user to grasp the top rail, similar to a handle, allowing for manipulation and movement of the barrier device. The central portion comprised of a material allowing for a foldable assembly, wherein the central portion is configured to be folded from a collapsed to an extended position. In the preferred assembly, the central portion is pleated, wherein the central portion is segregated into sections and can be assembled in a stacked and flattened configuration in the collapsed position.

DETAILED DESCRIPTION OF THE INVENTION

Figure 1:
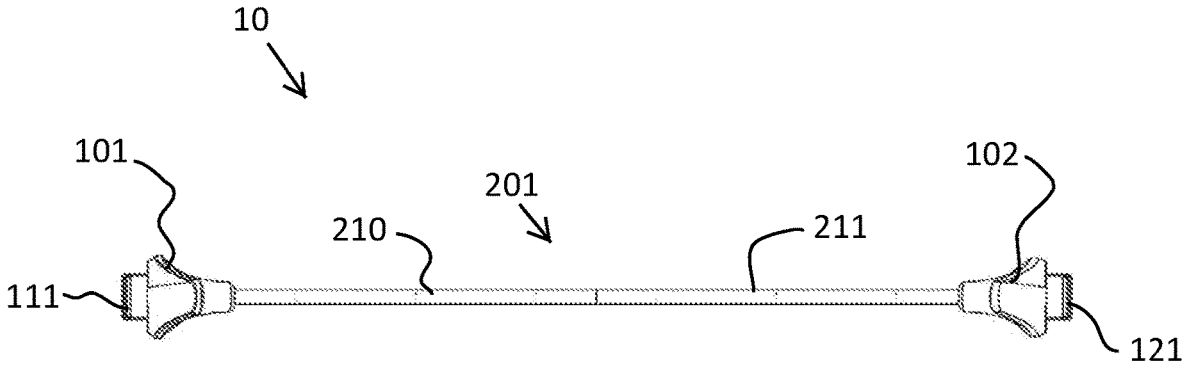
FIG. 1 shows the top of the barrier device, according to the present disclosure.

The following detailed description includes references to the accompanying drawings, which forms a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense.

Before the present invention is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the disclosure made herein.

Unless otherwise indicated, the words and phrases presented in this document have their ordinary meanings to one of skill in the art. Such ordinary meanings can be obtained by reference to their use in the art and by reference to general and scientific dictionaries.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances Furthermore, the recitation of one or more preferred embodiments does not imply that other embodiments are not useful, and is not intended to exclude other embodiments from the scope of the invention.

As used herein, the term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

Following are more detailed descriptions of various related concepts related to, and embodiments of, methods and apparatus according to the present disclosure. It should be appreciated that various aspects of the subject matter introduced above and discussed in greater detail below may be implemented in any of numerous ways, as the subject matter is not limited to any particular manner of implementation. Examples of specific implementations and applications are provided primarily for illustrative purposes.

The present disclosure is generally related to a protective divider configured as a barrier and segregating an object from damage. Most particularly, the disclosure relates to a barrier device and system movable from a collapsible to an expanded position for protecting a vehicle within a structure, such as a garage. The device of the present disclosure is provided with an interchangeable/customized panels in the form of a central portion to allow a user a certain amount of personalization.

Figure 2:
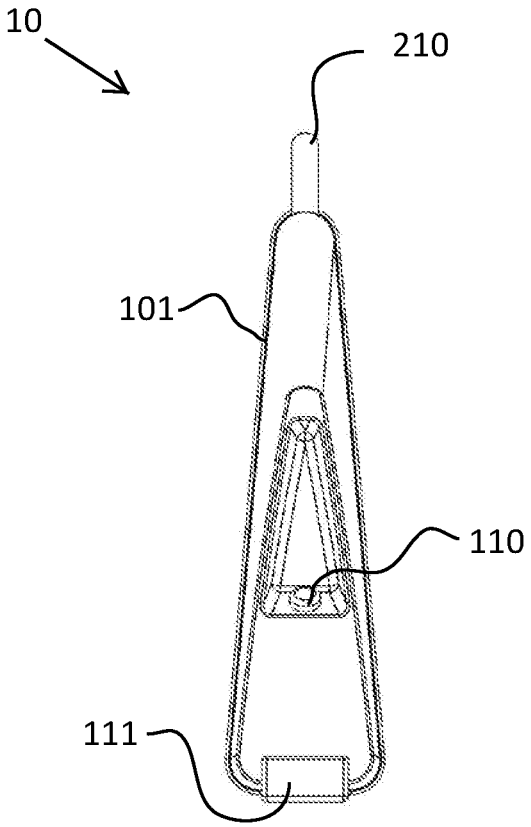
FIG. 2 shows the right of device, according to the present disclosure.
Figure 3:
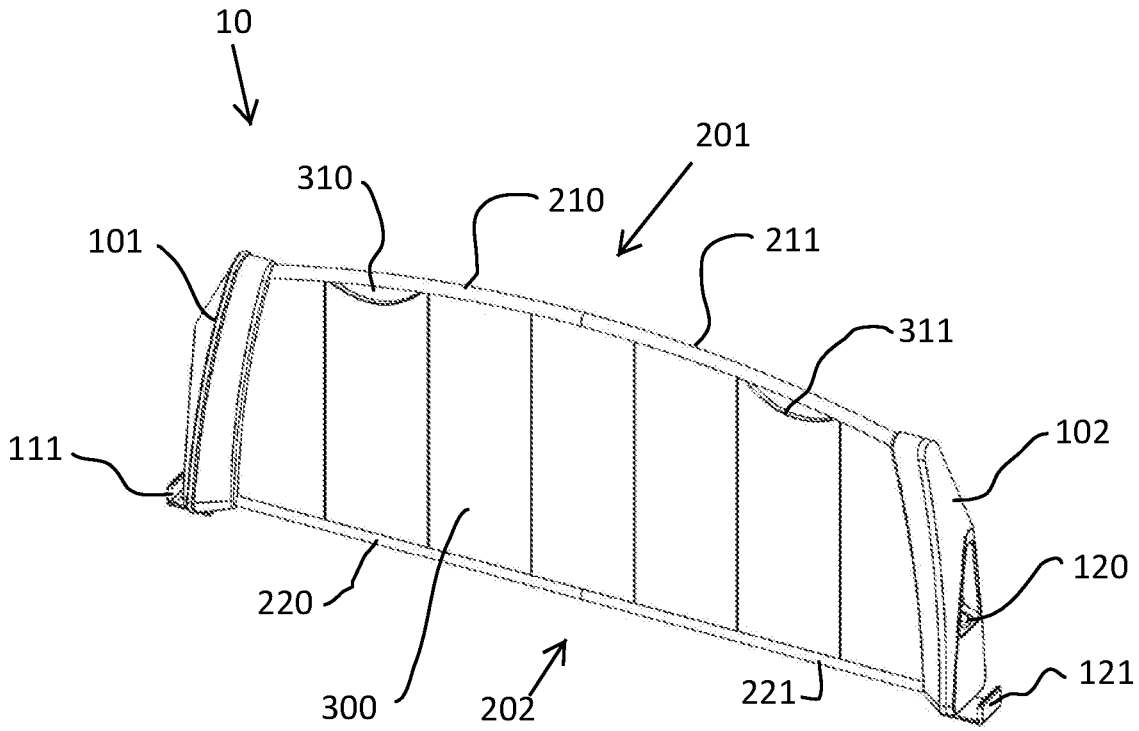
FIG. 3 shows a perspective of the device, according to the present disclosure.
Figure 4:
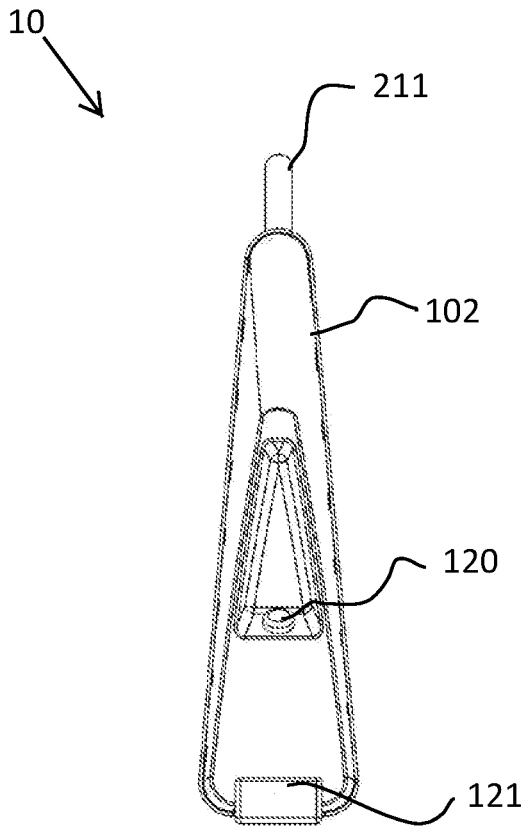
FIG. 4 shows the left of device, according to the present disclosure.
Figure 5:
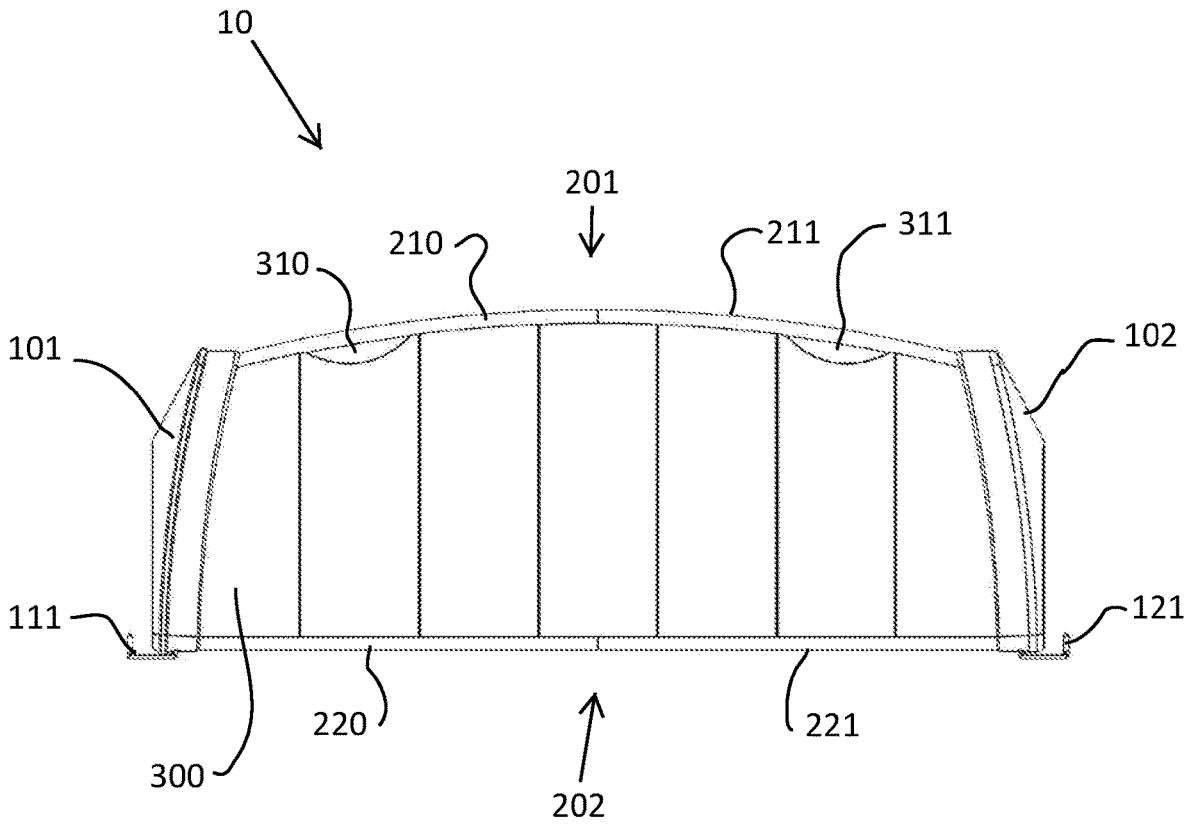
FIG. 5 shows the front of device, according to the present disclosure.
Figure 6:
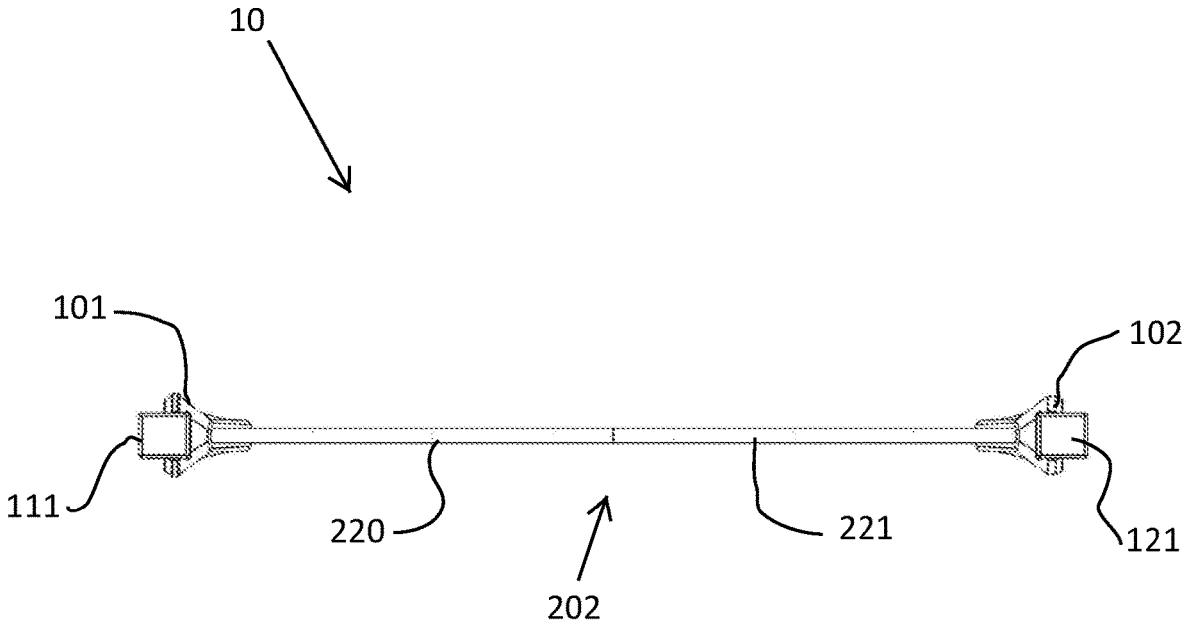
FIG. 6 shows the bottom of device, according to the present disclosure.
Figure 7:
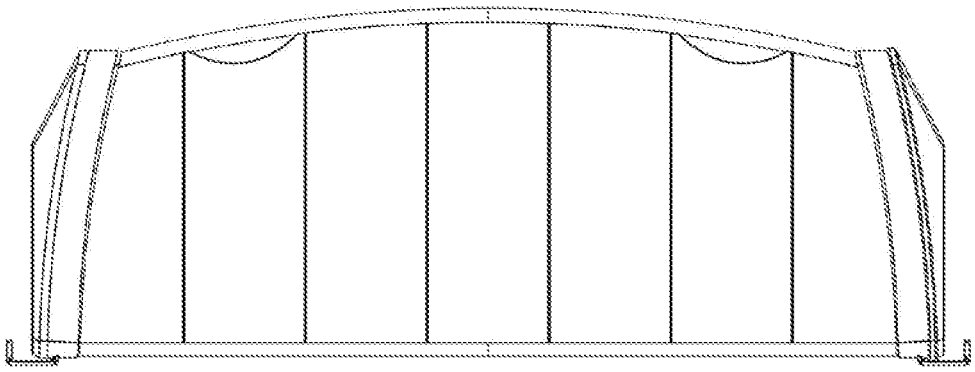
FIG. 7 shows the back of device, according to the present disclosure.

Referring to the figures, FIG. 1 to FIG. 7 show the device of the present disclosure generally adapted as a protective divider that may be placed adjacent to a vehicle for protecting the vehicle and generally referred to as device 10. The device 10 is provided in an assembly to shields automobiles from accidental damage while parked within a structure, such as a garage. The device 10 may be used more generically as a barrier to section or cordon off an area.

The protective barrier device 10 is configured to form a protective barrier adjacent to a vehicle and withstand high impacts and includes a structural assembly with a low center of gravity to prevent tipping and provide stability. The barrier device 10 of the present disclosure is provided in an assembly that is movable from a collapsed to an extended position, wherein the barrier device 10 is easily converted from an assembly for storage or shipping. Accordingly, the barrier device 10 functions as a protective divider to keep an automobile damage free and more generically section or cordon off a designated area.

The protective barrier device 10 includes a pair of cooperating base members 101, 102, a pair of rail members 201, 202, and a center portion 300. The base members 101, 102 comprising a first base member 101 and a second base member 102 generally configured to provide stability to the device 10 and adapted as mirrored images of each other. The base members 101, 102 configured for placement on the opposed ends of the barrier device 10, wherein the base members 101, 102 define the ends of the device 10.

Each base member 101, 102 of the pair of base members 101, 102 constructed of a housing forming a generally hollow cavity 400. The cavity 400 enclosed and accessible through a cover member 110, 120, wherein a user can remove the cover 110, 120 for access to the cavity 400 enabling the filling of the cavity 400 with a material, such as, but not limited to, sand or water to increase the weight of the base members 101, 102. Each base member 101, 102 of the pair of base members 101, 102 further including a movable foot member 111, 121. Each foot of the movable foot members 111, 121 configured to secure an adjacent base member 101, 102 in a coupling, wherein multiple devices 10 can be aligned in an adjacent coupling by engaging a corresponding foot member 111, 121 within a bottom portion of the base member 101, 102.

The pair of rail members 201, 202 comprising a top rail 201 and a bottom rail 202. The rail members 201, 202 further comprised of a pair of sections 210, 211; 220, 221 in an assembly to make the complete top rail 201 and the bottom rail 202. The sections 210, 211; 220, 221 of the rail members 201, 202 preferable assembled in a nested assembly, wherein one section of the sections is nestedly received within a hollow interior of the adjacent section. Accordingly the sections 210, 211; 220, 221 can be assembled without the use of tools. Although a nested receipt is preferred for the sections 210, 211; 220, 221, other assembly configurations may be used including the addition of a connecting section to enable connection of the adjoining sections 210, 211; 220, 221.

The rail members 201, 202 extending between the base members 101, 102 and coupled to and connecting the base members 101, 102 on and interior side. In the preferred embodiment, the top rail 201 is generally arcuate in shape wherein a central portion of the arc of the top rail 201 is the intersection of the pair of sections 210, 211 and positioned at a height above the height of the pair of base members 101, 102.

The central portion 300 is configured for coupling in the space between the assembly of the pair of rail members 201, 202 and the pair of base members 101, 102 to form a generally continuous structure of the device. The central portion 300 functioning as a solid panel between the boarding components of the rail members 201, 202 and the base members 101, 102. The central portion 300 shaped to correspond to the assembly space and coupled to the rails 201, 202 and members 101, 102. An upper edge 301 of the central portion 300 including a pair of cut-outs 310, 311 adjacent to the top rail 201 to generally form a gap between the central portion 300 upper edge 301 and top rail 201, wherein the cut-outs 310, 311 generally allow a user to grasp the top rail 201, similar to a handle, allowing for manipulation and movement of the barrier device 10.

The central portion 300 comprised of a material allowing for a foldable assembly, wherein the central portion 300 is configured to be folded from a collapsed to an extended position. In the preferred assembly, the central portion 300 is pleated, wherein the central portion 300 is segregated into sections and can be assembled in a stacked and flattened configuration in the collapsed position.

Preferably, the device 10 components are constructed out of a resilient and durable material and configured with the addition of soft and protective materials, such as foams and rubbers, on exterior surfaces. Accordingly, these components are selected to protect objects and vehicles from damage when contacting the device 10.

While the invention has been described above in terms of specific embodiments, it is to be understood that the invention is not limited to these disclosed embodiments. Upon reading the teachings of this disclosure many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

What is claimed is:

1. A protective barrier device provided in an assembly, the device comprising:

a pair of base members, each base member of the pair of members being identical in shape having a hollow cavity, and positioned at opposed ends of the device, the hollow cavity accessible through a cover member, wherein a material can be added to the cavity to increase a weight of each base member;

a top rail, the top rail coupled to each base member of the pair of base members;

a bottom rail, the bottom rail positioned below the top rail and coupled to each base member of the pair of base members; and a central portion, the central portion being a panel coupled to the top rail, the bottom rail, and each base member, wherein the central portion, the top rail, the bottom rail and each base member are coupled in a continuous structure, wherein the central portion comprises of a foldable material;

wherein the top rail is arcuate in shape, wherein the device is configured to be folded from a collapsed to an extended position, wherein an upper edge of the central portion includes a pair of cut-outs, each cut-out of the pair of cut-outs forming a gap between the top rail and the central portion, wherein each cut-out of the pair of cut-outs allows a user to grasp the top rail; and wherein each base member of the pair of base members includes a foot member, the foot member configured to engage an adjacent base member of an additional device in the assembly, wherein multiple devices can be coupled together to form an extended barrier.

2. The protective barrier device provided in the assembly as in claim 1, wherein the top rail is comprised of a pair of sections in the assembly.

3. The protective barrier device provided in the assembly as in claim 1, wherein the bottom rail is comprised of a pair of sections in the assembly.

4. The protective barrier device provided in the assembly as in claim 3, wherein the top rail is comprised of a pair of sections in the assembly.

5. A protective barrier device provided in an assembly, the device comprising:

a pair of base members, each base member of the pair of members being identical in shape having a hollow cavity, and positioned at opposed ends of the device, the hollow cavity accessible through a cover member, wherein a material can be added to the cavity to increase a weight of each base member;

a top rail, the top rail comprised of a pair of sections, the sections coupled to each other with the top rail coupled to each base member of the pair of base members;

a bottom rail, the bottom rail comprised of a pair of sections positioned below the top rail and coupled to each base member of the pair of base members; and a central portion, the central portion being a foldable panel and coupled to the top rail, the bottom rail, and each base member, wherein the central portion, the top rail, the bottom rail and each base member are coupled in a continuous structure, wherein the central portion further comprises protective materials selected to protect objects from damage when contacting the device;

wherein the top rail is arcuate in shape, wherein an upper edge of the central portion includes a pair of cut-outs, each cut-out of the pair of cut-outs forming a gap between the top rail and the central portion, wherein each cut-out of the pair of cut-outs allows a user to grasp the top rail; and wherein each base member of the pair of base members includes a foot member, the foot member configured to engage an adjacent base member of an additional device in the assembly, wherein multiple devices can be coupled together to form an extended barrier.

6. A protective barrier device provided in an assembly and movable between a collapsed position and an assembled position, the device comprising:

a pair of base members, each base member of the pair of members being identical in shape having a hollow cavity, and positioned at opposed ends of the device, the hollow cavity accessible through a cover member, wherein a material can be added to the cavity to increase a weight of each base member;

a top rail, the top rail arcuate in shape and comprised of a pair of sections, the sections coupled to each other with the top rail coupled to each base member of the pair of base members;

a bottom rail, the bottom rail comprised of a pair of sections positioned below the top rail and coupled to each base member of the pair of base members;

a central portion, the central portion being a foldable panel and coupled to the top rail, the bottom rail, and each base member, wherein the central portion, the top rail, the bottom rail and each base member are coupled in a continuous structure; and wherein the device is configured to be folded from a collapsed to an extended position;

wherein an upper edge of the central portion includes a pair of cut-outs, each cut-out of the pair of cut-outs forming a gap between the top rail and the central portion, wherein each cut-out of the pair of cut-outs allows a user to grasp the top rail; and wherein each base member of the pair of base members includes a foot member, the foot member configured to engage an adjacent base member of an additional device in the assembly, wherein multiple devices can be coupled together to form an extended barrier.

* * * * *